United States Patent [19]

Vrzalik

[11] Patent Number: 5,008,965

[45] Date of Patent: Apr. 23, 1991

[54] FLUIDIZED BEAD BED

[75] Inventor: John H. Vrzalik, San Antonio, Tex.

[73] Assignee: Kinetic Concepts, Inc., San Antonio, Tex.

[21] Appl. No.: 217,685

[22] Filed: Jul. 11, 1988

[51] Int. Cl.[5] ..... A61G 7/00

[52] U.S. Cl. ..... 5/61; 5/450; 5/453; 5/455

[58] Field of Search ..... 5/61, 449, 450, 453, 5/455, 456, 469, 403–406

[56] References Cited

U.S. PATENT DOCUMENTS 3,428,973 2/1969 Hargest et al. .
3,428,973 2/1969 Hargest et al. .
3,485,240 3/1969 Fountain .
3,866,606 2/1975 Hargest .
4,483,029 11/1984 Paul .
4,498,205 2/1985 Hino .
4,564,965 1/1986 Goodwin ..... 5/507 X
4,637,083 1/1987 Goodwin .
4,768,250 9/1988 Kato ..... 5/453

FOREIGN PATENT DOCUMENTS

WO8801158 2/1988 PCT Int'l Appl. .
648099 2/1985 Switzerland .

*Primary Examiner*—Michael F. Trettel
*Attorney, Agent, or Firm*—Cox & Smith Incorporated

[57] ABSTRACT

A fluidized patient support apparatus is disclosed. The apparatus utilizes granular material beneath a patient support surface which when fluidized by pressurized gas uniformly distributes the pressure imparted to the body of a patient lying thereon. The apparatus includes means for recirculating the fluidizing gas in order to avoid raising the ambient temperature of a room in which the bed is situated with exhaust gas. Also provided are a pair of inflatable bladders and selective fluidization means to assist in turning and transferring the patient.

47 Claims, 6 Drawing Sheets

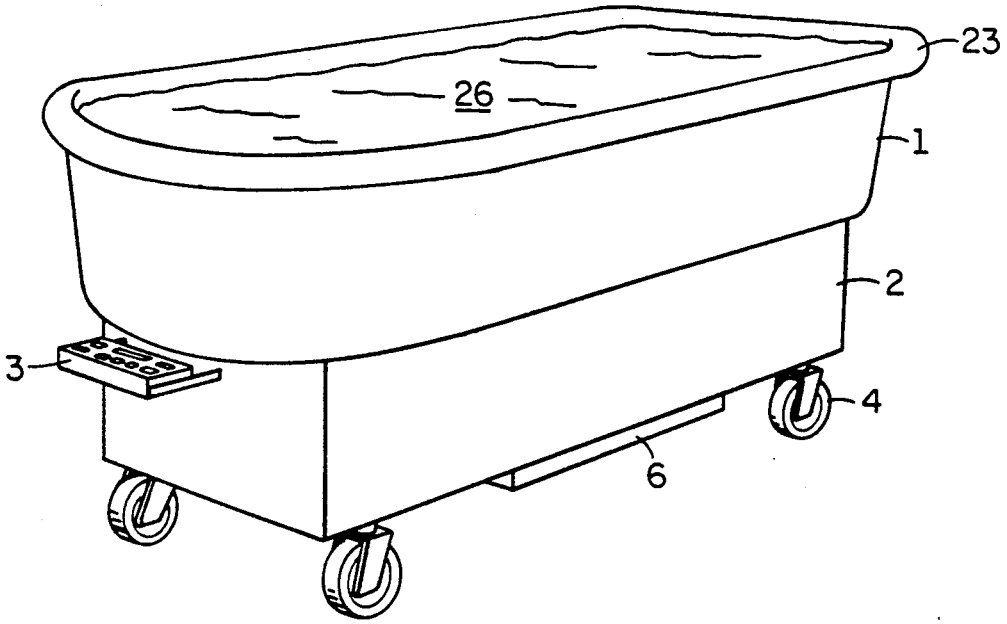
FIG. 1
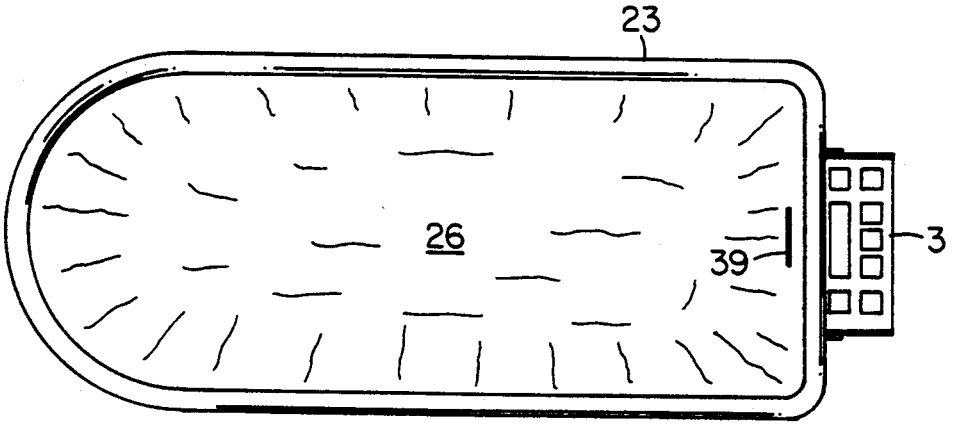
FIG. 2
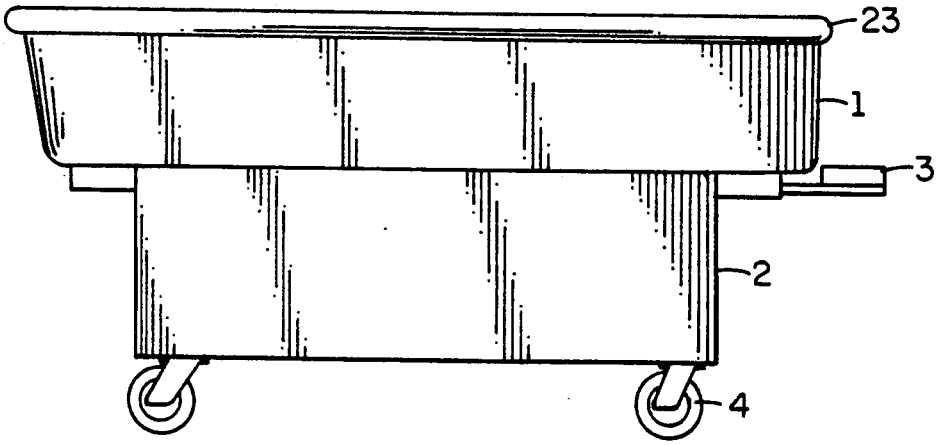

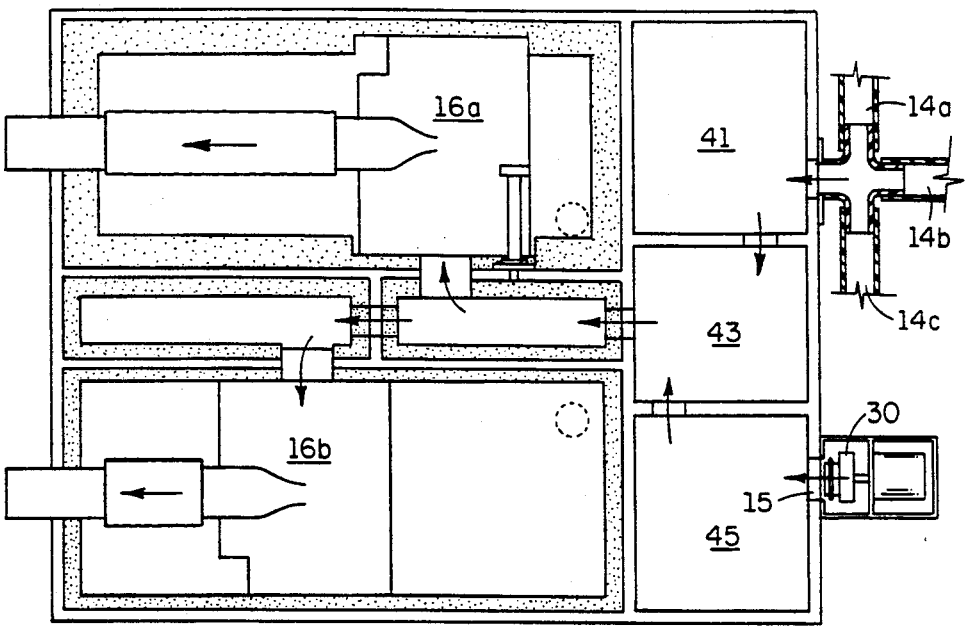
FIG. 10
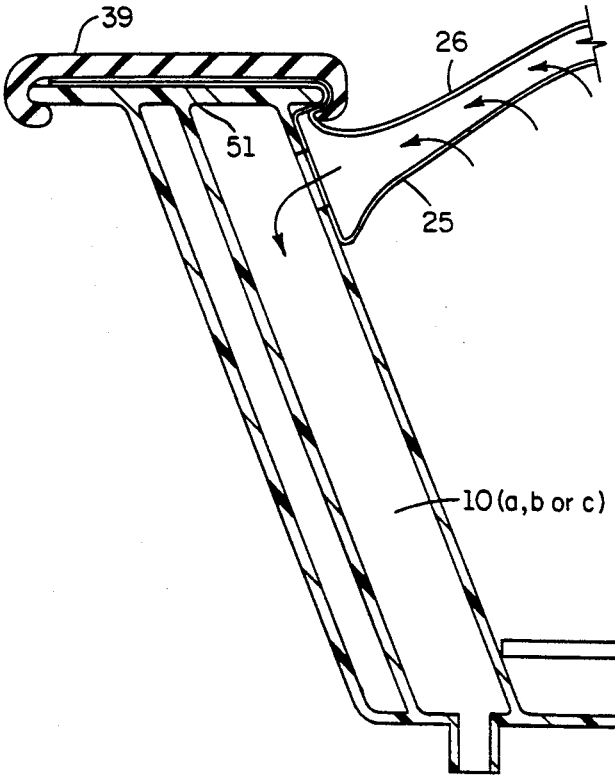
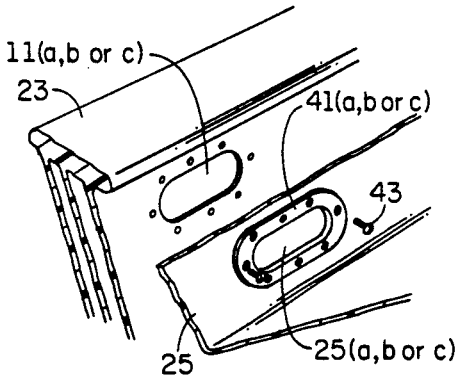
FIG. 11
FIG. 12

FLUIDIZED BEAD BED

FIELD OF THE INVENTION

The present invention relates to improvements in fluidized patient supporting systems of the type described in U.S. Pat. No. 3,428,973, the disclosure of which is hereby incorporated by reference.

BACKGROUND OF THE INVENTION

Burn Patients, and other Patients subject to extensive recuperative periods, must remain in bed for extended periods of time. When such patients lie supinely on a conventional mattress, most of the load is born by protuberances of the posterior surface of the body such as the heels, the buttocks, the scapulae, and the occipital region of the head. The relatively small areas of soft tissue at these points are then subjected to high pressures by being compressed between the skeleton and the supporting surface. When this pressure becomes great enough to cause collapse of small capillaries and veins, pressure sores or decubitus ulcers may result. Burn patients also have problems with rubbing against the surface of an immobile conventional mattress surface which can result in the extraction of a skin graft. In order to overcome these problems, hospital beds have been developed which use fluidized granular material (preferably spherical beads) as a supporting medium in order to uniformly distribute the supporting pressure points along the body surface, thus reducing the pressure at the aforementioned critical areas.

Fluidized bead beds comprise a tank partially filled with a mass of some granular material, the granular material resting on top of a diffuser board. A flexible, loose fitting sheet, which is permeable to air but not the granular material, is laid on top of the granular material to form the patient support surface. A gas, commonly air, is blown through the diffuser board into the granular material fluidizing the material so that a patient laying on top of the covering sheet is buoyantly suspended upon the bed. In this way, the forces imparted to the body are evenly distributed over the body and the chance of decubitus ulcers occurring is greatly lowered. Burn patients lie more comfortably, and the fluidized support medium moves with the body which reduces the likelihood of skin graft extraction. Also, this structure allows body fluids exuded from wounds to flow through the covering and into the granular material away from the patient, quickening the healing process. When the granular material is not being fluidized, the material settles down into a solid structure and contours to the body.

Although fluidized bead beds are quite satisfactory in accomplishing the objectives enumerated above, they are not without some disadvantages. When bead beds are operated for an extended period of time, heating of the room air becomes a problem. This is because the air used to fluidize the beads must be pressurized by a compressor or other type of blower. The air is necessarily heated as the compressor does work on it, and when the air is exhausted through the cover sheet, the ambient temperature of the room is raised. Another disadvantage comes about when it is desired to transfer a transfer the patient off of the bed because the level of the granular material supporting the patient is below the rim of the tank. The situation is worsened if the bed is fluidized since the patient sinks even further down. Another difficult arises when it is desired to roll the patient on his side in order to perform various clinical procedures. The location of the surface within the tank structure below the level of the rim makes it difficult for hospital personnel to manually roll the patient over onto his side. The procedure is rendered even more difficult in the case of burn patients who are sensitive to manual manipulation.

Therefore, it is an object of the present invention to provide a fluidized bead bed capable of operating without exhausting heated air into the room.

It is a further object to provide a fluidized bead bed with a means for positioning a patient on his side with no need for manual manipulation of the patient by hospital personnel.

It is a still further object to provide a fluidized bead bed with a means for facilitating the transfer of the patient off of the bed.

SUMMARY OF THE INVENTION

According to the present invention, a fluidized bead bed is provided with two inflatable bladders residing within the granular material along the length of the bed and each attached to opposite sides of the bottom of the tank structure. Electrically operated valves control the flow of air from the air compressors used to fluidize the granular material, thus enabling the bladders to be inflated or deflated by operation of a control panel. When one bladder is inflated, the patient is rolled over to the opposite side. This motion is facilitated by a plurality of longitudinally oriented plenum chambers beneath the diffuser board, the flow of air to which is individually controllable with electrically operated valves. Regions of the bed immediately above each plenum chamber can thus be selectively defluidized. By inflating the bladder on one side of the bed and then defluidizing that side of the bed support surface, the patient is rolled over onto the other side.

A means for recirculating the air used to fluidize the granular material is also provided. A top cover sheet made of gas impermeable material, such as GORE-TEX material is placed over the bottom air permeable cover sheet. Both sheets are secured to the rim of the tank structure. At certain points along the inner wall of the tank structure, recirculation ducts provide a pathway for the air back to the intake of the compressor. Openings in the bottom cover sheet allow the exhaust air to flow into corresponding ports located on each recirculation duct. The borders of the bottom cover sheet openings are securely fastened around each port in order to prevent granular material from entering the recirculation ducts.

Also provided is a porous plastic diffuser board which allows air to flow across it with a much smaller pressure drop than conventional diffuser boards made of fiberboard. The use of a porous plastic diffuser board allows the use of variable speed centrifugal compressors rather than regenerative compressors, the latter producing the high discharge pressure necessary to force air through a diffuser board made of fiberboard. The lower discharge pressure of the centrifugal compressor means that less work is done on the air, thus, heating it less. This allows the aforementioned recirculation to occur without overheating the patient support surface of the bed. A resistance heater is also provided to heat the air if the compression work done on the air does not raise its temperature sufficiently. The variable speed feature of the compressors enable the total fluidization pressure to be reduced when selective regions of the patient support surface are defluidized by blocking air flow to selected plenum chambers.

BRIEF DESCRIPTION OF THE DRAWINGS

FIG. 1 is a perspective view of the fluidized bead bed.

FIG. 2 shows a view looking downward on the fluidized bead bed.

FIG. 3 is a side view of the fluidized bead bed.

FIG. 10 shows in a top sectional view the intake manifolds of the compressors.

FIG. 11 shows the openings of the bottom filter sheet securely fastened to the corresponding ports of the exhaust ducts.

FIG. 12 is a sectional view of the tank wall showing the top cover sheet and bottom filter sheet fastened to the tank rim.

DESCRIPTION OF THE PREFERRED EMBODIMENT

Figure 4:
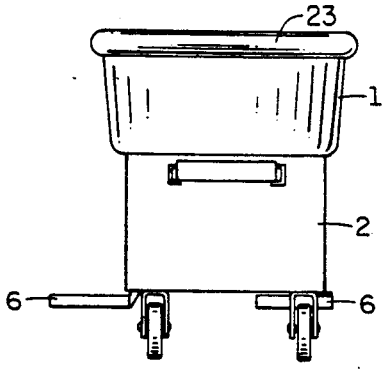
FIG. 4 is an end view of the fluidized bead bed.

FIGS. 1, 2, 3 and 4 show a fluidized bead bed in various views. The bed comprises an open tank structure 1 which is mounted on top of a housing 2. At the bottom of the housing 2 are locking wheels 4 which enable the bed to be easily moved and then locked into place. Attached to the rim 23 of the tank 1 is the top cover sheet 26 which forms the patient support surface of the bed. Also shown is a step 6 which hinges outwardly from the housing 2 allowing easier access to the patient by hospital personnel. A control panel 3 enables the user to control the operation of the bed in a manner described more fully below. The control panel comprises a microprocessor based controller which can control the operation of the bed according to input from the control panel or according to a previously stored program.

Figure 6:
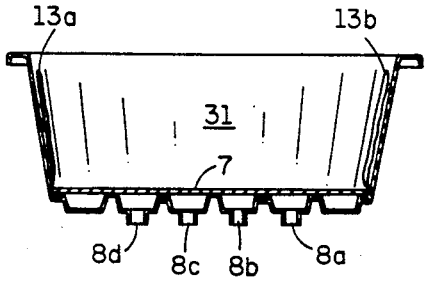
FIG. 6 is a transverse sectional view of the tank.
Figure 5:
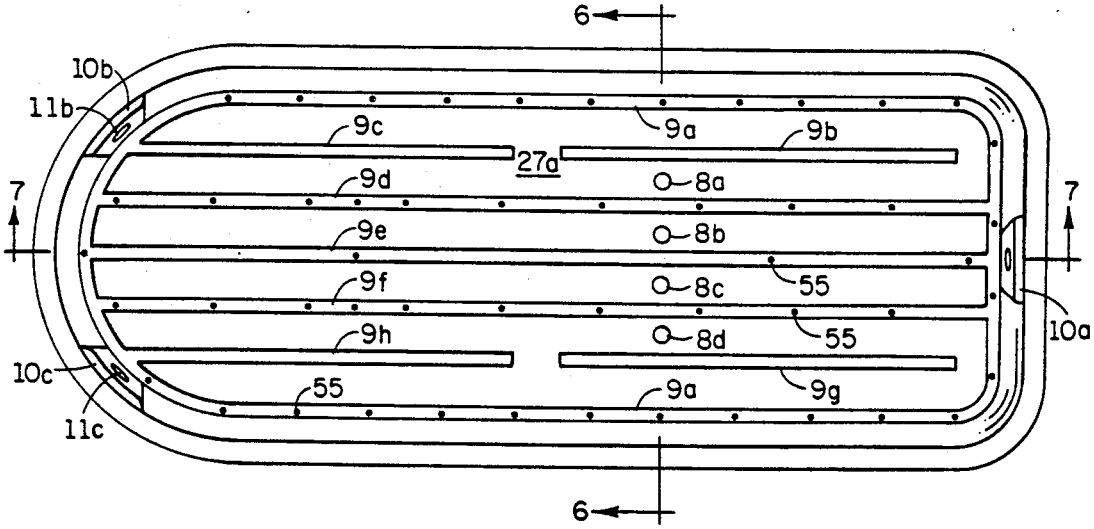
FIG. 5 is a top view of the bed with the diffuser board and sheets removed.
Figure 7:
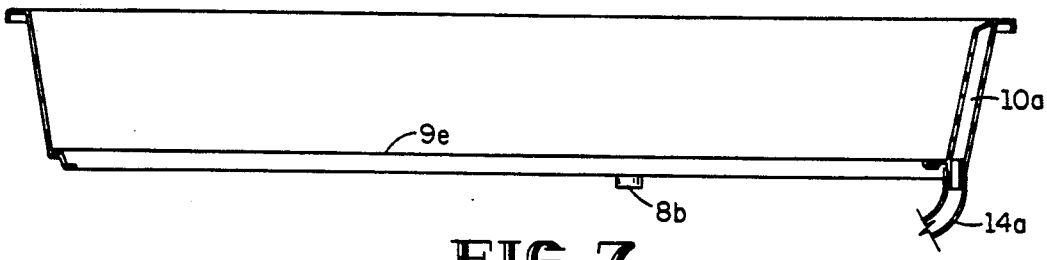
FIG. 7 is a saggital sectional view of the bed.
Figure 9:
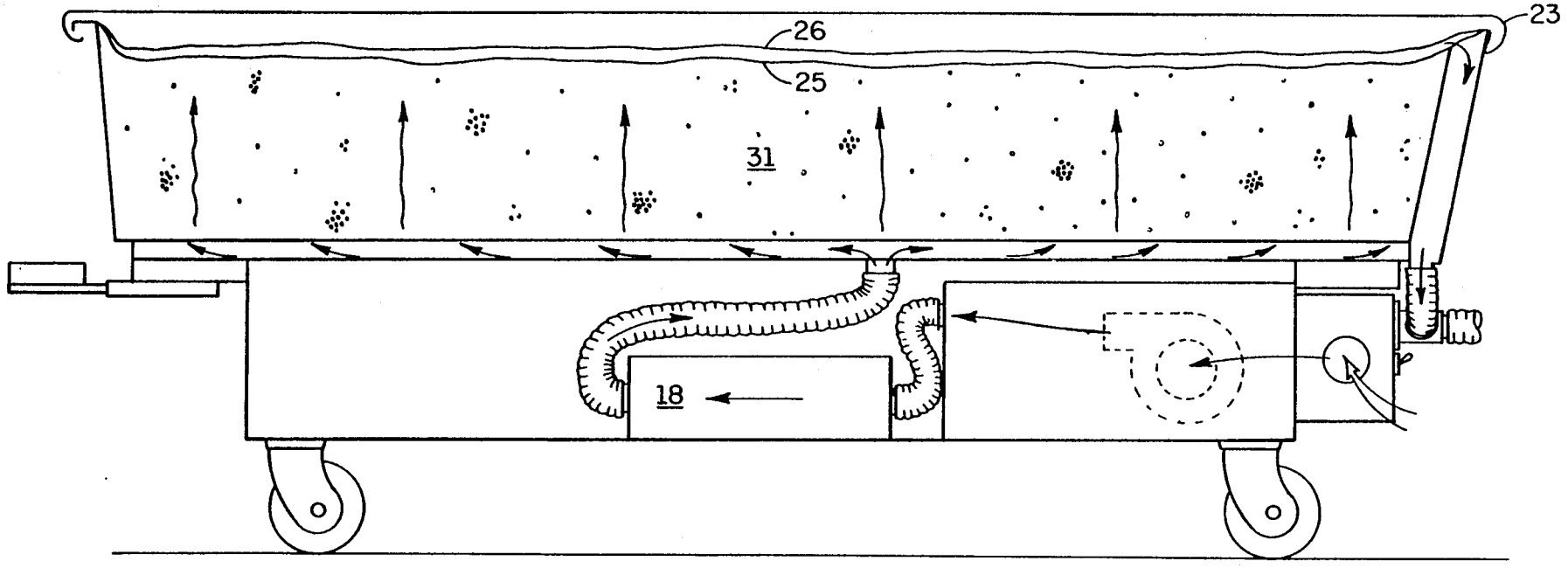
FIG. 9 shows in a partly sectional view the air flow pathways for both recirculation and conventional modes.

FIG. 5 is a top view of the bottom of the tank 1. Diffuser board supports 9*a–h* run longitudinally from one end of the tank to the other. As shown in FIGS. 6 and 7, a porous plastic diffuser board 7 lies on top of the supports 9*a–h*. The granular material 31, which preferably consists of spherical beads, resides on top of the diffuser board 7. On top of the beads 31 is a bottom filter sheet 25 which underlies the top cover sheet 26 as shown in FIG. 9. Both sheets attach to the rim 23.

Diffuser board 7 is bolted down to diffuser board supports 9*a–h* at bolt holes 55 which are located on the top of all the supports 9*a–h* as shown in FIG. 5. Silicon sealant is applied to the top of the supports 9*a–h* before the diffuser board 7 is mounted thereon in order to ensure an airtight seal between the plenum chambers. Sealant is also applied around the diffuser board 7 where it contacts the tank wall to prevent air from escaping between the tank wall and the diffuser board. The top surfaces of diffuser board support 9*a*, which runs along the inside tank wall, are scalloped between the bolt holes 55 in order for air to pass under the diffuser board 7 at those areas. This ensures adequate fluidization all the way to the tank walls when the apparatus is operating.

FIG. 12 is a sectional view of the flanged rim 23 of the tank 1. Top cover sheet 26 and bottom filter sheet 25 fit over the rim 23. A Velcro strip 51 is attached all along the top of rim 33 which mates to a corresponding strip on the bottom filter sheet 25. Retaining rim cover 39 slips over the rim 23 to securely hold the two sheets in place. As seen in FIG. 11, exhaust openings 25*a–c* in the bottom filter sheet 25 fit over corresponding exhaust ports 11*a–c* of the exhaust ducts 10*a–c*. Filter sheet 25 is securely fastened to the walls of exhaust ducts 10*a–c* by grommets 41*a–c* which fit over the borders of openings 25*a–c* and ports 11*a–c*. Screws 43 fasten the grommets 41*a–c* to the walls of exhaust ducts 10*a–c*. Grommets 41*a–c* ensure that the filter sheet does not separate from the walls of the exhaust ducts 10*a–c* which would allow granular material to flow into the exhaust ducts 10*a–c*.

Pressurized air from centrifugal compressors 16*a–b* flows to an air box 18 and then through fluidization ports 8*a–d* in the bottom of the tank 1. Compressors 16*a–b* are variable speed type which enables greater fluidization pressure upon start-up when the beads are cold and humid as well as facilitating selective fluidization as described below. The air then flows through diffuser board 7 to fluidize the beads 31. The air is exhausted through the bottom filter sheet 25 which is permeable to air but not to the beads. If the bed is operated in a conventional mode without the top cover sheet 26, the air is exhausted into the room through the bottom filter sheet 25. The top cover sheet, however, is made of GORE-TEX material or other air impermeable material which prevents the air from being exhausted into the room. Instead the exhaust air is captured between the sheets where it flows through exhaust ports 11*a–c* into exhaust ducts 10*a–c* as shown in FIGS. 5, 7 and 12. The air flowing through exhaust ducts 10*a–c* may be either recirculated to the intake of the compressors 16*a–b* or exhausted into the room through an air outlet 39 which consists of a VELCRO fly in the top cover sheet which may be opened or closed according to whether the apparatus is to be operated in a conventional or recirculation mode.

Figure 8:
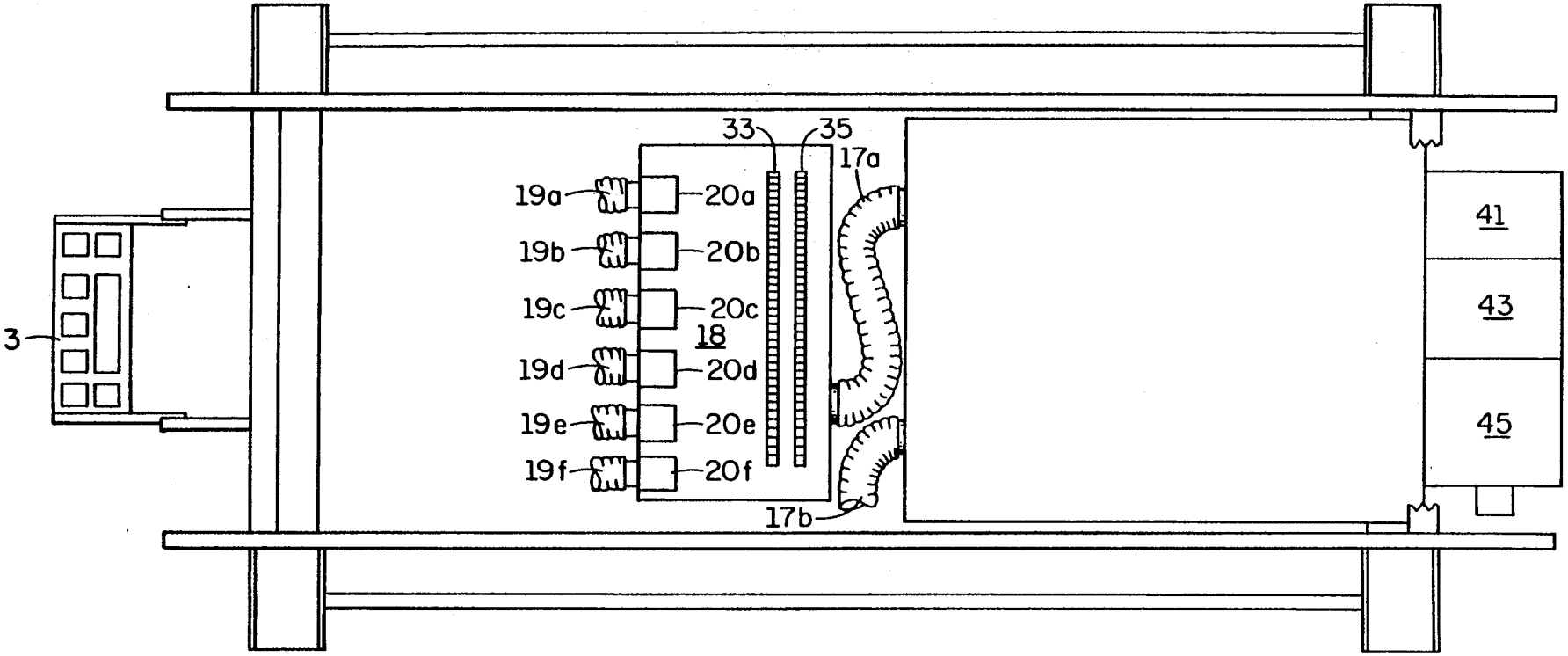
FIG. 8 shows the air box and hose connections within the housing.

FIGS. 8, 9 and 10 show the air system according to the preferred embodiment. In the recirculation mode, the air intake of compressors 16*a–b* is supplied from the exhaust ducts 10*a–c* which communicate with a recirculation intake chamber 41 via exhaust hoses 14*a–c* which are connected as shown in FIG. 10. The air then enters suction manifold 43 before going to the compressors 16*a–b*. Alternatively, intake air is supplied by room air entering the room air intake chamber 45 through vent 15. Which intake source is utilized is controlled by recirculation valve 30 which can be actuated from control panel 3. As shown in FIG. 10, valve 30 is positioned in vent 15 so that when closed, the intake air for the compressors is drawn from recirculation intake chamber 41.

When valve 30 is opened, the suction produced by compressors 16*a–b* draws air into room air intake chamber 45. Because the flow resistance of the recirculation pathway is higher than the room air pathway, substantially all of the intake air comes from room air intake chamber 45 when valve 30 is opened.

As shown in FIG. 8, air from the compressors 16*a–b* enters air box 18 via discharge hoses 17*a–b*. From the air box 18, the air flows through air box valves 20*a–f* into air box hoses 19*a–f*. Valves 20*a–f* can be individually actuated from control panel 3. Hoses 19*a–d* connect with fluidization ports 8*a–d* while hoses 19*e–f* are connected to bladders 13*a–b*, the operation of which is described below. As shown in FIG. 5, diffuser board supports 9*a*, 9*d*, 9*e*, and 9*f* define four plenum chamber 27*a–d* beneath the diffuser board 7. The other diffuser board supports serve only to support the diffuser board 7. By adjusting air box valves 20*a–d*, the flow of air into the four plenum chambers may be controlled. This enables the selective fluidization of the beads immediately above each plenum chamber. In this manner, one side of the patient may be lowered with respect to the other simply by reducing the degree of fluidization on the opposite side of the bed. The variable speed feature of the compressors 16*a–b* enables the total fluidization pressure to be reduced when air flow into selected plenum chambers is blocked. This serves to prevent overfluidization of the patient support surface above the other plenum chambers.

Inside air box 18 is a resistance heater 33. Because the compression ratio of the centrifugal compressors 16*a–b* is so low, initial compression of the intake air may not heat the air sufficiently to avoid patient discomfort. For this reason, heater 33 is provided and controlled by a thermostat. When the bed is operated in a recirculation mode, the air will usually warm sufficiently upon successive compression cycles that heater 33 will cut off. In the preferred embodiment, the operation of the recirculation valve 30 is also part of a temperature control loop so that recirculation is halted when the temPerature becomes too high. Also provided within air box 18 is a disinfecting heater 35 for heating the air sufficiently to kill microbes in the granular material 31.

Figure 13A:
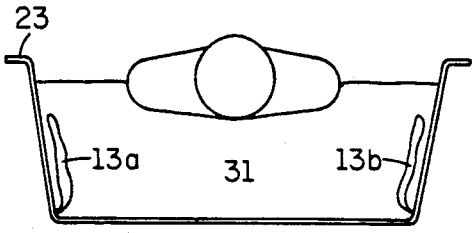
FIGS. 13A-C illustrate the steps involved in rolling the patient onto one side.
Figure 13B:
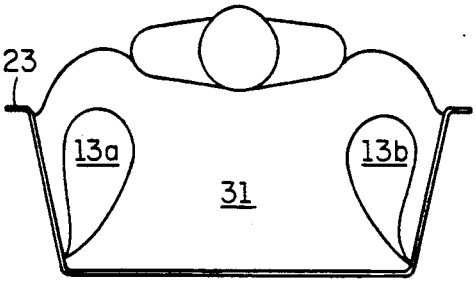
Figure 13C:
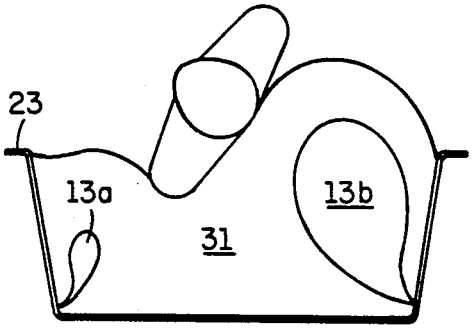

As shown in FIG. 6, bladders 13*a–b* are located adjacent each wall of the tank within the granular material 31. The bladders are constructed of GORE-TEX material or other air impermeable material. Both bladders are oriented longitudinally and attached to the tank walls at the bottom of the tank above the diffuser board so that when one is inflated, one side of the patient support surface is raised relative to the other. The air supply for bladders 13*a* and 13*b* flows through air box hoses 19*e* and 19*f*, respectively, which pass to the bladders through holes in the bottom of the tank 1 and in the diffuser board 7. The flow of air is controlled by air box valves 20*c* and 20*f* which, when open, cause the separate inflation of the bladders. A deflation outlet located at some point in the air supply system allows the bladders to deflate when the air supply is cut off by venting the bladders to atmosphere. By utilizing the selective fluidization feature and the inflatable bladders, the present invention allows an operator to roll the patient onto one side as well as facilitating transfer of the patient off of the bed. Both procedures may either be implemented manually from the control panel or under programmed microprocessor control. The rolling operation will be described first with reference to FIG. 13A–C. FIG. 13A shows a patient lying on the bed with both bladders 13*a–b* deflated and fully fluidized with all plenum chambers open. In order to roll the patient onto one side, both bladders are first inflated as shown in FIG. 13B. The granular material must be in a fluidized state before the bladders can be inflated due to the weight of the granular material. Next, bladder 13(*a*) is deflated and air flow to plenum chambers 27*b–d* is halted by closing air box valves 20*b–d*. Thus, the patient falls into the fluidized region by rolling onto one side as shown in FIG. 13C. The patient can be rolled onto the opposite side by deflating the opposite bladder and defluidizing the opposite side of the bed.

Figure 14A:
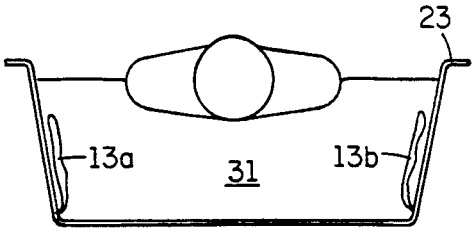
FIGS. 14A-C illustrate the procedure for transferring the patient off of the bed.
Figure 14B:
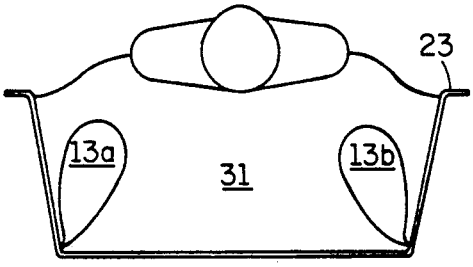
Figure 14C:
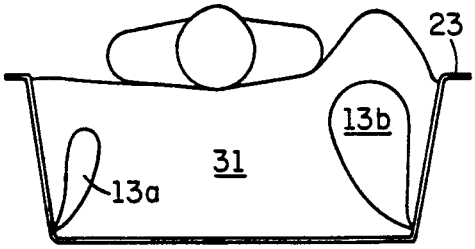

The procedure for transferring the patient from the bed is illustrated in FIGS. 14A–C. FIG. 14A shows the bed fully fluidized and with both bladders deflated. The level of the granular material 31 is seen to be below the rim 23 of the tank 1. The patient lies even lower having sunk into the fluidized granular material. In order to raise the patient to the level of the rim 23, both bladders 13*a–b* are first inflated. Next, the bed is totally defluidized by closing air box valves 20*a–d* which blocks air flow to plenum chambers 27*a–d*. The resulting position is shown in FIG. 14B. By deflating bladder 13*a*, the level of the granular material on that side falls to the level of the rim 23 as shown in FIG. 14C. The patient can then be easily transferred off of that side. By deflating the opposite bladder, the patient may be transferred off of the other side.

Although the invention has been described in conjunction with the foregoing specific embodiment, many alternatives, variations and modifications are apparent to those of ordinary skill in the art. Those alternatives, variations and modifications are intended to fall within the spirit and scope of the appended claims.

What is claimed is:

1. A fluidized patient support apparatus, comprising:

an elongated open tank for containing a mass of granular material;

a filter sheet which is gas permeable but impermeable to the granular material, securely fastened to the rim of the tank so as to form a patient support surface;

a plurality of diffuser board supports on the bottom of the tank, said supports at least partially defining a first elongated plenum chamber along one side of said tank and a second elongated plenum chamber along the opposite side of said tank;

a porous plastic diffuser board mounted on top of the diffuser board supports in communication with said plenum chambers; and means for flowing gas into the bottom of the tank and through the diffuser board at rates sufficient to fluidize the granular material, said flowing means being adapted such that the rate gas flows into said first elongated plenum chamber is variable relative to the rate gas flows into said second elongated plenum chamber, thereby enabling selective lowering of one side of a patient supported by said granular material relative to the other side of the patient.

2. The support apparatus as set forth in claim 1 wherein the gas flowing means is a centrifugal compressor.

3. A fluidized patient support apparatus, comprising:

an open tank for containing a mass of granular material;

a filter sheet which is gas permeable but impermeable to the granular material, securely fastened to the rim of the tank so as to form a patient support surface and having an exhaust opening;

a plurality of diffuser board supports on the bottom of the tank;

a porous diffuser board mounted on top of the diffuser board supports;

means for flowing gas into the bottom of the tank and through the diffuser board at a rate sufficient to fluidize the granular material;

an exhaust duct within the wall of the tank fluidly connected to the intake of the gas flowing means and having an exhaust port opening into the interior of the tank;

a gas impermeable top cover sheet positioned on top of the filter sheet and securely fastened to the rim of the tank; and means for sealingly fastening the filter sheet around the exhaust opening to the exhaust duct around the exhaust port.

4. The support apparatus as set forth in claim 3 additionally comprising:

a vent for allowing the intake of the gas flowing means to be supplied by room air;

a valve for opening and closing the vent; and an outlet in the top cover sheet for exhausting gas into the room.

5. The support apparatus as set forth in claim 4 wherein the outlet in the top cover sheet comprises a selectively openable fly.

6. A fluidized patient support apparatus; comprising:

an open tank for containing a mass of granular material;

a filter sheet which is gas permeable but impermeable to the granular material, securely fastened to the rim of the tank so as to form a patient support surface;

a plurality of diffuser board supports on the bottom of the tank;

a porous plastic diffuser board mounted on top of the diffuser board supports;

means for flowing gas into the bottom of the tank and through the diffuser board at a rate sufficient to fluidize the granular material;

two longitudinally oriented inflatable bladders fastened to the inner walls of the tank; and means for separately inflating the bladders with pressurized gas.

7. The support apparatus as set forth in claim 6 wherein the diffuser board supports are longitudinally oriented ridges which define a plurality of plenum chambers when the diffuser board is mounted on top of the diffuser board supports and additionally comprising separate valves controlling the flow of gas into each plenum chamber from the gas flowing means.

8. A fluidized patient support apparatus, comprising:

an elongated tank for containing a mass of granular material therein, said tank having a diffuser board mounted therein, and said granular material being contained above said diffuser board;

a filter sheet which is gas-permeable but which is impermeable to the granular material, fastened along a perimeter to said tank above said mass of granular material for covering said mass of granular material while allowing passage of fluidizing gas therefrom;

a ridge at least partially defining a plurality of elongated plenum chambers in separate communication with different portions of said diffuser board, said chambers being oriented parallel to the longitudinal axis of said tank; and means for flowing gas into said plenum chambers for diffusion through said diffuser board and into said granular material to fluidize said granular material.

9. The fluidized patient support apparatus of claim 8, further comprising:

a flow control for controlling flow of gas into a first one of said plenum chambers separate from a second one of said plenum chambers.

10. The fluidized patient support apparatus of claim 9, wherein said ridge sealingly engages said diffuser board to support said diffuser board and define said plenum chambers immediately beneath said diffuser board.

11. A fluidized patient support apparatus, comprising:

a tank for containing a mass of granular material therein, said tank having a diffuser board mounted therein, and said granular material being contained above said diffuser board;

means for flowing gas upwardly through said diffuser board and into said granular material to fluidize said granular material;

a filter sheet which is gas-permeable but which is impermeable to the granular material, fastened along a perimeter to said tank above said mass of granular material for covering said mass of granular material while allowing passage of fluidizing gas therefrom;

a cover sheet which is gas-impermeable relative to said filter sheet, said cover sheet being positioned above said filter sheet and fastened along a perimeter to said tank;

an exhaust duct defining an exhaust port in direct communication with a space defined between said filter sheet and said cover sheet, said exhaust duct being fluidly connected by means of a fluid passage to an intake of said gas flowing means for allowing passage of air between said space and said gas flowing means.

12. The fluidized patient support apparatus of claim 11 further comprising control means for controlling flow of fluidizing gas to avoid undesirable heating of said granular material.

13. The fluidized patient support apparatus of claim 11 wherein said duct is within a wall of said tank.

14. The fluidized patient support apparatus of claim 11 wherein:

said tank has an upper rim; and said duct is connected to said tank beneath said upper rim and extends toward said gas flowing means in a direction generally downwardly from said rim.

15. A fluidized patient support apparatus, comprising:

a tank for containing a mass of granular material therein, said tank having a diffuser board mounted therein, and said granular material being contained above said diffuser board;

means for flowing gas upwardly through said diffuser board and into said granular material to fluidize said granular material;

a filter sheet which is gas-permeable but which is impermeable to the granular material, fastened along a perimeter to said tank above said mass of granular material for covering said mass of granular material while allowing passage of fluidizing gas therefrom;

an exhaust duct defining an exhaust port in direct communication with a space defined above said filter sheet, said exhaust duct being fluidly connected by means of a fluid passage to an intake of said gas flowing means for allowing passage of air between said space and said gas flowing means to achieve heating of said granular material when desired.

16. The fluidized patient support apparatus of claim 15, wherein:

said control means includes a selectively actuable valve for controlling flow of fluidizing gas through said exhaust duct to achieve heating of said granular material when desirable and to avoid heating of said granular material when undesirable.

17. A fluidized patient support apparatus, comprising:

a tank for containing a mass of granular material therein, said tank having a diffuser board mounted therein, and said granular material being contained above said diffuser board;

means for flowing gas upwardly through said diffuser board and into said granular material to fluidize said granular material;

a filter sheet which is gas-permeable but which is impermeable to the granular material, fastened along a perimeter to said tank above said mass of granular material for covering said mass of granular material while allowing passage of fluidizing gas therefrom;

an inflatable bladder mounted within said tank; and means for inflating said bladder.

18. The fluidized patient support apparatus of claim 17, wherein:

said bladder is mounted within said tank by means of a fluid connection through a wall of said tank, said fluid connection enabling passage of fluid from said inflating means to the interior of said bladder.

19. The fluidized patient support apparatus of claim 17 wherein:

said bladder is immersed within said mass of granular material; and said inflating means is selectively actuable for selectively inflating said bladder.

20. A fluidized patient support apparatus, comprising:

an elongated tank having a plurality of walls for containing a mass of granular material therein, said tank further having a diffuser board mounted therein, and said granular material being contained above said diffuser board;

a pump for flowing gas upwardly through said diffuser board and into said granular material to fluidize said granular material;

a sheet which is impermeable to the granular material and which is positioned above said mass of granular material for providing a surface upon which a patient is supported; and means for varying the relative elevation of the surface of the granular material beneath one side of said patient relative to the elevation of an upper edge of a first one of said walls.

21. The fluidized patient support apparatus of claim 20, wherein:

said elevation varying means is adapted to vary the elevation of at least the one side of said patient to an elevation which is relatively higher than the upper edge of said first one of said walls, thereby facilitating transfer of said patient over said first one of said walls.

22. The fluidized patient support apparatus of claim 20, wherein:

said elevation varying means comprises means for elevating at least the one side of said patient relative to said diffuser board.

23. The fluidized patient support apparatus of claim 20, wherein:

said elevation varying means comprises means for selectively displacing volumes of said mass of granular material in a manner such that the elevation of said sheet is varied relative to said diffuser board.

24. The fluidized patient support apparatus of claim 23, wherein:

said displacing means comprises an expandable means.

25. The fluidized patient support apparatus of claim 20 wherein:

said elevation varying means comprises an inflatable bladder.

26. The fluidized patient support apparatus of claim 25 wherein:

said inflatable bladder is positioned within said tank.

27. The fluidized patient support apparatus of claim 20, wherein said elevation varying means comprises:

a pair of inflatable bladders located within said tank; and means for inflating said pair of inflatable bladders.

28. The fluidized patient support apparatus of claim 27, wherein said pair of bladders are located adjacent opposite side walls of said tank.

29. A fluidized patient support apparatus, comprising:

an elongated tank having a diffuser board mounted therein and containing a mass of granular material above said diffuser board and below the top of a side wall of the tank;

a pump for flowing gas upwardly through said diffuser board and into said granular material to fluidize said granular material for supporting a patient;

sheet means which is impermeable to the granular material and which is positioned above said mass of granular material for providing a surface on which a patient is supported; and expandable means formed integral with the side wall of the tank for raising and lowering the level of the granular material relative to the top of the side wall.

30. The fluidized patient support apparatus of claim 29, wherein:

said expandable means comprises inflatable means.

31. The fluidized patient support apparatus of claim 29, wherein:

said expandable means comprises an inflatable bladder extending along the side wall.

32. The fluidized patient support apparatus of claim 29, wherein:

said expandable means is positioned to upwardly displace volumes of said mass of granular material beneath at least one side of the patient when said expandable means is expanded.

33. A fluidized patient support apparatus, comprising:

an elongated tank having a diffuser board mounted therein and containing a mass of granular material above said diffuser board and below the top of a side wall of the tank;

a pump for flowing gas upwardly through said diffuser board and into said granular material to fluidize said granular material for supporting a patient;

sheet means which is impermeable to the granular material and which is positioned above said mass of granular material for providing a surface on which a patient is supported;

opposed inflatable bladders at each side of said tank; and means to selectively inflate said bladders to move a patient supported on said sheet means.

34. A fluidized patient support apparatus, comprising:
an elongated tank having a diffuser board mounted therein and containing a mass of granular material therein, said tank containing said granular material above said diffuser board;
a pump for flowing gas upwardly through said diffuser board and into said granular material to fluidize said granular material;
sheet means which is impermeable to the granular material and which is positioned above said mass of granular material for providing a surface on which a patient is supported; and
expandable means within said tank for raising one side of the patient relative to the other side of the patient.

35. A fluidized patient support apparatus, comprising:
an elongated tank containing a mass of granular material therein, said tank having a diffuser board mounted therein, and said granular material being contained above said diffuser board;
a pump for flowing gas upwardly through said diffuser board and into said granular material to fluidize said granular material;
sheet means which is impermeable to the granular material and which is positioned above said mass of granular material for providing a surface on which a patient is supported; and
means for varying the flow of gas into the granular material beneath one side of the patient relative to the flow of gas into the granular material beneath the other side of the patient.

36. The fluidized patient support apparatus of claim 35 wherein:
said varying means comprises a plurality of ribs defining a plurality of separate, elongated plenum chambers positioned parallel with said tank and side-by-side beneath said diffuser board.

37. The fluidized patient support apparatus of claim 35 further comprising:
expandable means positioned off-center within said tank for upwardly displacing volumes of said mass of granular material beneath said one side of the patient.

38. A method for facilitating transfer of a patient from atop a fluidized patient support apparatus that includes an elongated tank having a plurality of walls containing a mass of granular material therein covered by a support surface for supporting a patient, comprising the steps of:
varying the elevational relationship between an upper edge of a side wall and a support surface on which a patient is supported such that at least one side of the patient is raised above the upper edge of said side wall, said side wall being a side wall of the tank of a fluidized patient support apparatus containing a granular material for supporting the patient on the support surface, thereby enabling transfer of the patient over said side wall.

39. The method of claim 38 wherein said varying step further includes the step of:
expanding a bladder within said tank beneath said support surface such that said bladder occupies a greater volume within said tank and, consequently, said support surface is elevated.

40. The method of claim 38 wherein said varying step comprises the steps of:
expanding an off-center bladder within said tank to upwardly displace volumes of said mass of granular material beneath said one side of the patient; and
retarding downward flow of said upwardly displaced volumes of said mass of granular material.

41. The method of claim 40 wherein:
said retarding step comprises reducing the flow of gas through said upwardly displaced volumes of said mass of granular material.

42. The method of claim 38 wherein said varying step further includes the steps of:
relative to the upper edge of said side wall, first causing both sides of the patient to be raised above the upper edge of said side wall; and
second causing the side of the patient which is closest to said side wall to be lowered relative to said side wall.

43. The method of claim 42 wherein:
said first causing step comprises inflating a pair of baffles positioned along the opposite side walls of said tank; and
said second causing step comprises partially deflating the one of said baffles closest to said first side wall.

44. The method of claim 43 further comprising:
fluidizing said mass of granular material prior to said first causing step; and
reducing the flow of gas through said upwardly displaced volumes of said mass of granular material to retard downward flow thereof.

45. A method for facilitating transfer of a patient from atop a fluidized patient support apparatus that includes an elongated tank having a plurality of walls containing a mass of granular material therein covered by a support surface for supporting a patient, comprising the steps of:
controlling inflation of a bladder along one wall of the tank of a fluidized patient support apparatus to change the level of at least part of a support surface supporting a patient above the granular material of the apparatus relative to the height of the wall.

46. The method of claim 45, further comprising the step of:
inflating a second bladder along an opposed wall the tank.

47. A method of supporting a patient on a fluidized patient support apparatus of the type comprising a tank containing a mass of granular material covered by a sheet which serves to support a patient comprising the steps of:
alternately inflating opposed bladders in the granular material to turn the patient from side to side.

* * * * *